US006036036A

United States Patent [19]

Bilani et al.

[11] Patent Number: 6,036,036

[45] Date of Patent: Mar. 14, 2000

[54] ADULT FRIENDLY CHILD-RESISTANT PACKAGE

[75] Inventors: Nady Bilani, Strombeek-Bever; Johan Willy Declerck, Ichtegem; Jelle Dankert Vuijk, Brussels, all of Belgium; Maurizio Pucci, Naples, Italy

[73] Assignee: The Procter & Gamble Company, Cincinnati, Ohio

[21] Appl. No.: 08/981,376

[22] PCT Filed: Jun. 4, 1996

[86] PCT No.: PCT/US96/08670

§ 371 Date: Mar. 2, 1998

§ 102(e) Date: Mar. 2, 1998

[87] PCT Pub. No.: WO97/01494

PCT Pub. Date: Jan. 16, 1997

[30] Foreign Application Priority Data

| | | | |
|---|---|---|---|
| Jun. 28, 1995 | [EP] | European Pat. Off. | 95201764 |
| Dec. 21, 1995 | [EP] | European Pat. Off. | 95203583 |

[51] Int. Cl.[7] ..... B65D 50/04

[52] U.S. Cl. ..... 215/216; 215/219

[58] Field of Search ..... 215/216, 217, 215/218, 219, 221, 253, 250, 330, 204, 207, 278; 220/281; 222/548, 551, 562

[56] References Cited

U.S. PATENT DOCUMENTS

| | | | |
|---|---|---|---|
| 3,917,097 | 11/1975 | Uhlig . | |
| 4,149,646 | 4/1979 | Julian . | |
| 4,752,014 | 6/1988 | House et al. . | |
| 4,948,002 | 8/1990 | Thorncock et al. | 215/215 X |
| 5,078,288 | 1/1992 | Fuchs . | |
| 5,383,564 | 1/1995 | Hamilton et al. . | |
| 5,462,182 | 10/1995 | Opresco | 215/217 X |

FOREIGN PATENT DOCUMENTS

| | | | |
|---|---|---|---|
| 603090 | 6/1994 | European Pat. Off. | 215/216 |
| 2676997-A1 | 12/1992 | France . | |
| WO 90/02692 | 3/1990 | WIPO . | |

*Primary Examiner*—Nathan Newhouse
*Attorney, Agent, or Firm*—Vanessa M. Nichols

[57] ABSTRACT

The child-resistant package (100) can be readily opened by an adult with a one-hand operation. The pushtab (123, 123'), which together with the interlocking tooth (119) form the child-resistant feature of the package, is placed on the closure (120). Therefore, an adult user may easily depress said pushtab and at the same time disengage said closure to open said package by using only one hand for both operations.

8 Claims, 16 Drawing Sheets

PRIOR ART

ADULT FRIENDLY CHILD-RESISTANT PACKAGE

FIELD OF THE INVENTION

The present invention relates to a package which is resistant to opening by the majority of children, yet which can be opened without undue difficulty by adults, also by those whose manual dexterity may, at least to a degree, be impaired.

BACKGROUND OF THE INVENTION

Child resistant packaging is understood to be a important concept for preventing inadvertent access by children, for example, to potentially dangerous liquid or dry products. However, inclusion of the child resistant feature adds difficulty and frustration for the adult user when attempting to open the package. Due to the difficulty in opening child resistant packages, many persons, especially elderly adults which may also have impaired strength and dexterity, could prefer a non-child resistant package substitute. Alternatively, when dangerous products are purchased in child resistant packages by adults, the child resistant package is often not reclosed in order to defeat the child resistant feature. As a result, the danger of child poisonings may increase in the homes.

The aforementioned problems are generally recognised in the packaging industry. Attempts to deal with these problems are also disclosed in the patent literature. For example, U.S. Pat. No. 4,948,002 issued to Thornock et al. on Aug. 14, 1990 discloses a package comprising a bottle, a collar which is secured in place over the uppermost portion of the bottle and a closure which is secured to the finish portion of the bottle. The collar preferably includes a pair of spring-like pushtabs containing vertical extensions which engage interlocking teeth on the innermost surface of the closure skirt when the closure is fully assembled onto the bottle. To remove the closure, the opposed pushtabs must be manually depressed prior to applying unscrewing torque to the closure to disengage the pushtab extensions from the interlocking teeth on the closure.

The package disclosed in '002 exhibits highly improved child resistance without significantly impeding access by adults. This has been further improved in WO 92/07286, in which a package is described whose child resistance is enhanced even further without making the package more difficult to open by adults. This is achieved, if the spring-like pushtabs containing vertical extensions are, at least to a degree, preloaded so as to exert a force against the innermost surface of the closure skirt once the closure has been fully assembled onto the package.

In both documents '002 and '286 the spring-like pushtabs containing vertical extensions are part of a transition piece attached to the bottle, like the collar of '002, or may be integral part of the bottle without any transition piece. Nonetheless, the user has to use both hands to allow him/her to overcome the child resistant feature and unscrew the closure. Indeed, firstly one hand has to hold the bottle and at the same time depress the spring-like pushtabs. Secondly, the closure has to be unscrewed with the other hand. This means that both hands are needed to actually disengage said child resistant closure from the bottle, which is called in the following a "two hand operation". We found that this two hand operation is difficult for larger containers having an unwieldy external shape, especially for elderly adults having impaired manual strength and dexterity. Indeed, it is more difficult for one hand to hold a large and/or heavy container and at the same time depress the pushtabs, especially when said pushtabs are located in the upper portion of said bottle.

It is therefore an object of the present invention to provide a child resistant package which is resistant to opening by the majority of children but which, at the same time, can readily be opened by adults without the need of a two hand operation.

SUMMARY OF THE INVENTION

The present invention is a child-resistant package comprising a container and a closure. Said package is suitable for storing and dispensing potentially dangerous products. Said container comprises an upper portion, said upper portion comprising a first engaging means for releasably securing said closure to said container. Said closure comprises an inner skirt which comprises second engaging means corresponding to said first engaging means of said upper portion for releasably securing said closure to said container. Said closure further comprises an outer skirt, generally concentrically aligned with said inner skirt. Said upper portion of said container further comprises at least an interlocking tooth, and said closure further comprises at least one resiliently deformable pushtab, and at least a part of said pushtab is inwardly movable when a squeezing force is applied to said inwardly movable part of said pushtab. Said pushtab has an exposed surface contour which generally conforms to the exterior surface contour of the adjacent portions of said outer skirt. Said interlocking tooth and said pushtab are so formed and positioned to prevent removing of said closure from said container to open said package unless said pushtab is first depressed to disengage said pushtab from said interlocking tooth before said container is opened. At least part of said pushtab faces the innermost surface of said interlocking tooth when said closure is disengaged from said container.

DETAILED DESCRIPTION OF THE INVENTION

Figure 1:
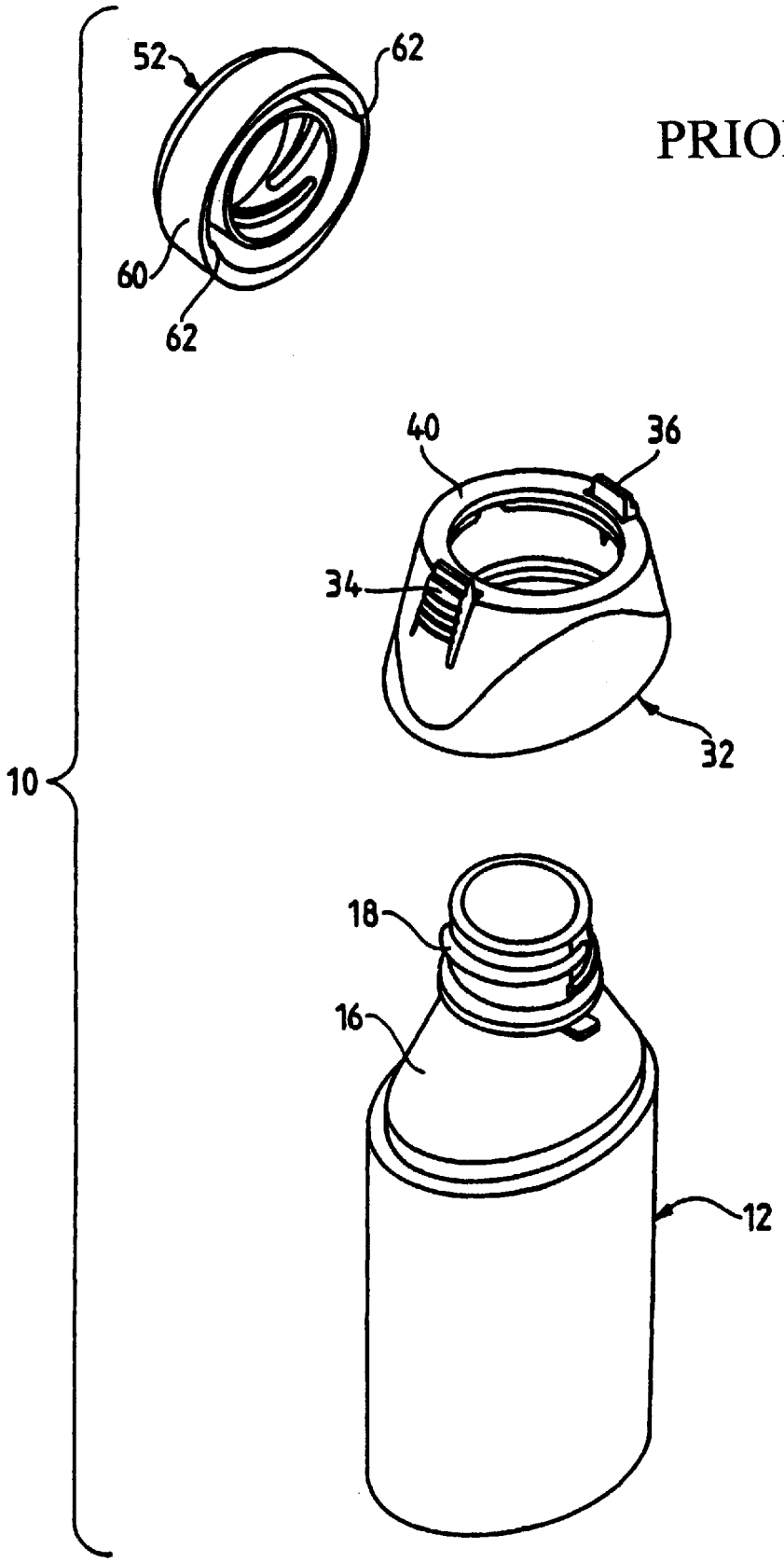
FIG. 1 is an exploded perspective view of a child resistant package of the prior art.

An embodiment of a child resistant package (10) of the prior art is shown in an exploded perspective view in FIG. 1. This package (10) is of the type generally disclosed in U.S. Pat. No. 4,948,002 and comprises a bottle (12), a collar (32) and a closure (52). Said collar (32) is attached onto the shoulder portion (16) of said bottle, and said closure is releasably secured to the finish portion (18) of said bottle. A possible means for releasably secure said closure to said bottle is a combination of lugs and screw threads. Said collar comprises at least a pushtab (34) with a vertical extension (36) which projects above the top edge (40) of said collar. Said vertical extension of said pushtab interlock with interlocking tooth (62) on the innermost surface of the outer skirt (60) of said closure (52) when said closure is in its closed rest position. In the following, the "closed rest position" is the position in which said closure is fully threaded onto said finish portion (18) of said bottle.

As described in WO 92/07286 on page 8, line 6 to page 10, line 17, said pushtab (34) may also be preloaded. This means that said pushtab exerts a pressing force against the innermost surface of said outer skirt (60) when said closure (52) is fully threaded onto said finish portion (18) of said bottle (12). Indeed, in this manner the child resistance of the package (10) is increased without at the same time causing a substantial increase of difficulty to open the package by adults.

In '002 as well as in '286, in order to unscrew closure (52) being in its closed rest position from said finish portion (18), said pushtab (34) must be depressed first with one hand. Consequently, said extension (36) of said pushtab is disengaged from said interlocking tooth (62). Then the user is able to unscrew said closure from said bottle (12) with the other hand. This two hand operation is necessary, since said pushtab is located on said collar (32) which remains fixed onto said finish portion during the unscrewing of said closure. Therefore, it is impossible in practice to depress said pushtab and to unscrew said closure together at the same moment with only one hand.

The need to squeeze the pushtabs with one hand holding also the bottle, while the other hand is unscrewing the closure, may be considered to be inconvenient and too complicated by the user. This may be the case, for example, when a package, due to its unwieldy external shape especially around said pushtabs in the upper portion of said package, needs a whole hand just to firmly hold said package. The difficulty to hold a package may be further increased by increasing the dimension and/or weight of said package. Indeed, it may be more difficult in this case to hold the package (10) at its upper portion and to depress concurrently with the same hand said pushtab of the child resistant closure as described in '002 and '286. We found that said package may slip from the hand and fall on the ground, especially when elderly adults having impaired manual strength and dextrity try to handle such a package. Consequently, said package falling on the ground may break with a partial or complete loss of the content.

Figure 2A:
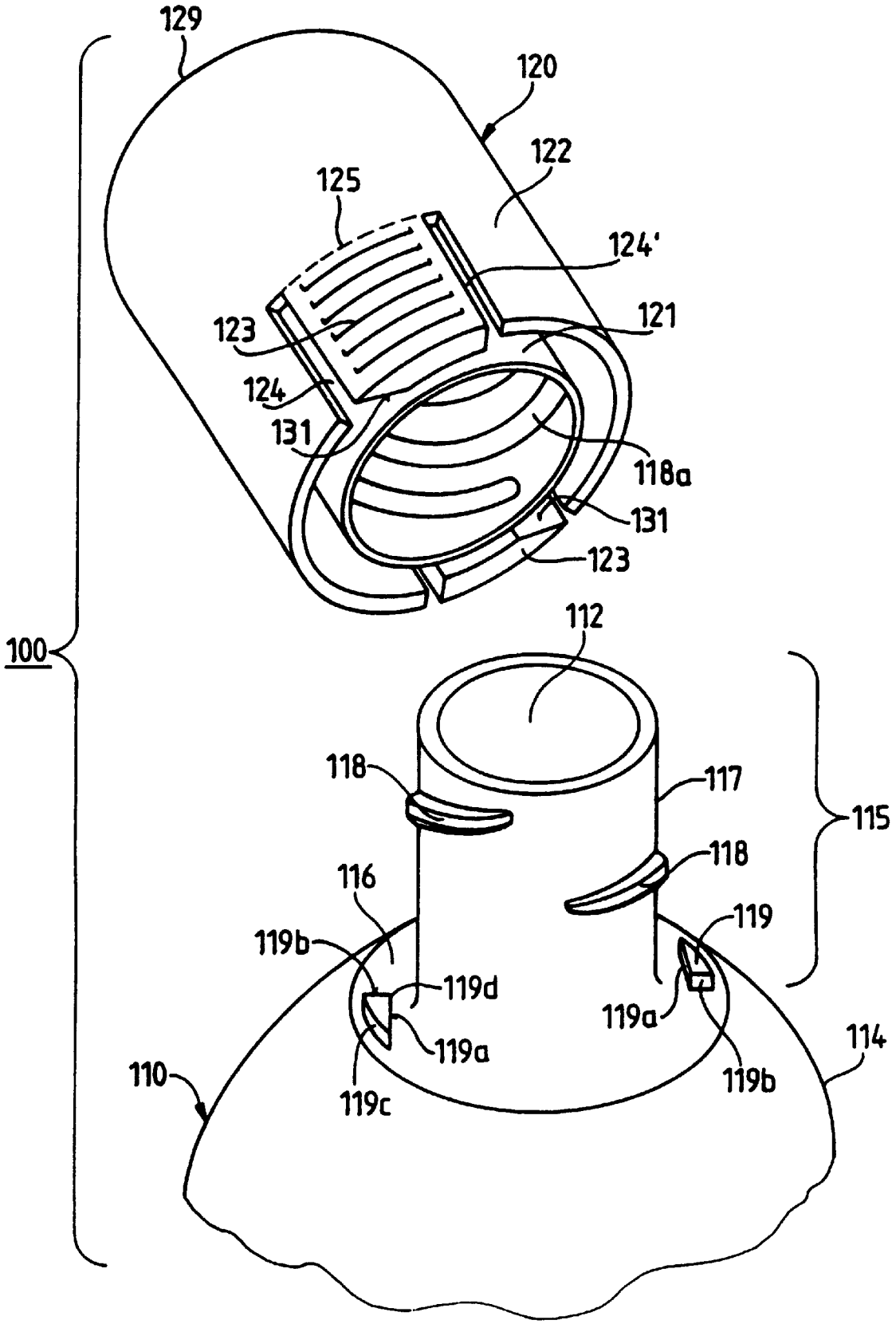
FIGS. 2*a* to 2*c* are exploded perspective views of embodiments of child resistant packages according to the present invention.

To avoid the before mentioned inconveniences, the present invention provides a package comprising a child resistant closure which can be opened with only one hand. In the following this is called "one hand operation", in contrast to the "two hand operation" defined above. This is achieved by the package (100) according to the present invention comprising a container (FIG. 2*a*, 110) and a closure (FIG. 2*a*, 120). As depicted in FIG. 2*a*, the container (110) according to the present invention comprises a hollow body (111). Said hollow body comprises a base wall (not shown), a side wall (114) and an upper portion (115). As a preferred option, said container may further comprise a handle.

Preferably, said container (FIG. 2*a*, 110) is made of thermoplastic material. Such thermoplastic materials have been extensively described in the art and include vinyl chloride based resins, polymers and co-polymers derived from olefins, acrylic polymers and co-polymers, polyethylene, polypropylene, polystyrene, polyethylene terephthalate, polyethylene terephthalate glycol, or mixtures thereof. Said container can be made of single or multi-layer extrusion of such materials. It can also comprise recycled thermoplastic materials. A preferred thermoplastic material used herein is polyethylene. The form of said hollow body may be cylindrical, whereby the cross section in a plane parallel to the container's supporting plane is square or rectangular, ovoid or circular. Said supporting plane is the plane on which said container stands on its base wall in its upright position.

Said upper portion (115) is located opposite to said base wall. Said upper portion comprises a shoulder portion (116), a neck portion (117) and at least one interlocking tooth (119). As a preferred option, said upper portion may be a transition piece which is attached to said container. Said neck portion of said upper portion defines an opening (112). Said upper portion further comprises a first engaging means (118) for releasably securing said closure to said container. Preferably, said first engaging means for releasably securing said closure to said container is located on said shoulder portion or on said neck portion.

Preferably, said first engaging means for releasably securing said closure to said container is a combination of lugs and screw threads located on the outermost surface of said upper portion. Another preferred first engaging means for releasably securing said closure to said container is a snapping mechanism comprising ribs and/or grooves also located on the outermost surface of said upper portion.

Figure 4B:
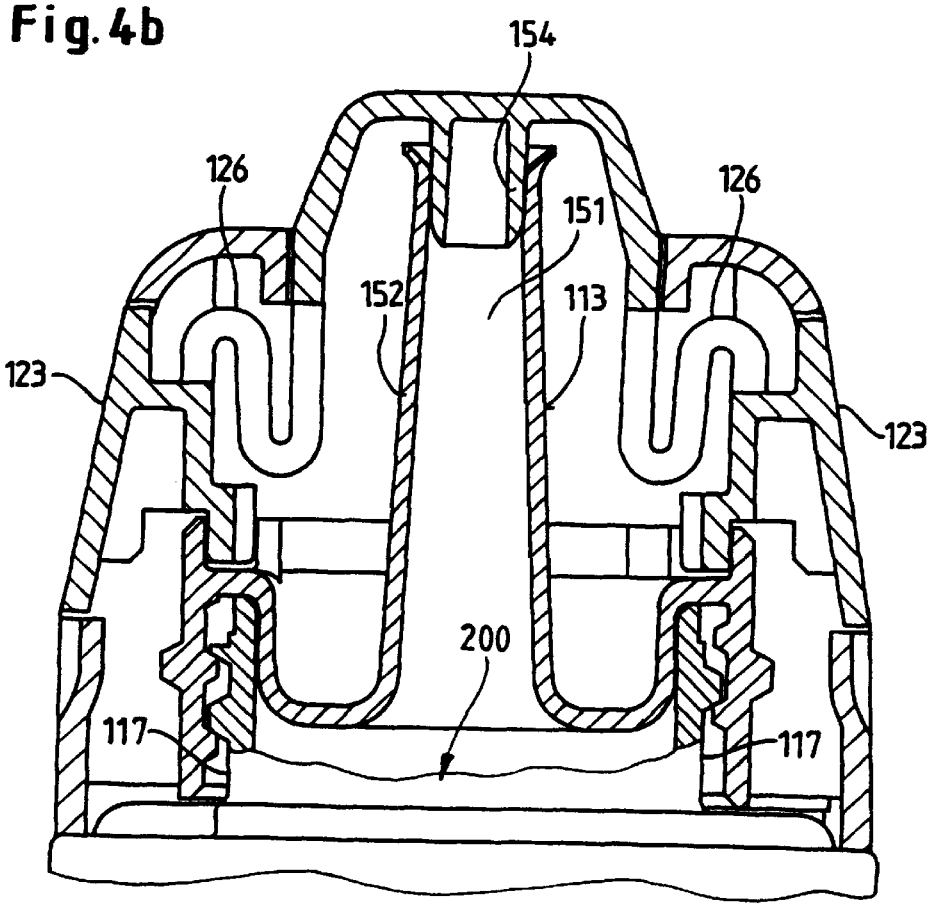
FIG. 4*b* is a cross sectional side view of an embodiment of a closure of a child resistant package according to the present invention.

Said neck portion may further comprise a spout (113) defining a reduced dispensing opening (151), as shown, for example, in FIG. 4*b*. Preferably, said spout is attached on said opening (112). Said spout comprises a channel (152) and attachment means. Said channel connects the interior of said container to said reduced dispensing opening. Said spout may be preferably attached on the innermost or outermost surface of said neck portion (117). Said attachment means between said spout and said neck portion may be achieved by threading or snapping mechanisms. When said spout is attached to the outermost surface of said neck portion, said spout may further comprises said first engaging means being a threading or snapping mechanism. Said spout may further comprise the interlocking tooth (119).

Said shoulder portion (FIG. 2*a*, 116) may be an integral part of said container. Said shoulder portion may also be a transition piece, like said spout (113), additionally attached to said container around said opening (112). Preferably, said interlocking tooth (119) is positioned on said shoulder portion. Preferably, said interlocking tooth comprises an inclined ramp (119*a*) and a radial wall (119*b*). Preferably, said shoulder portion comprises at least a pair of interlocking teeth opposing each other.

Figure 2B:
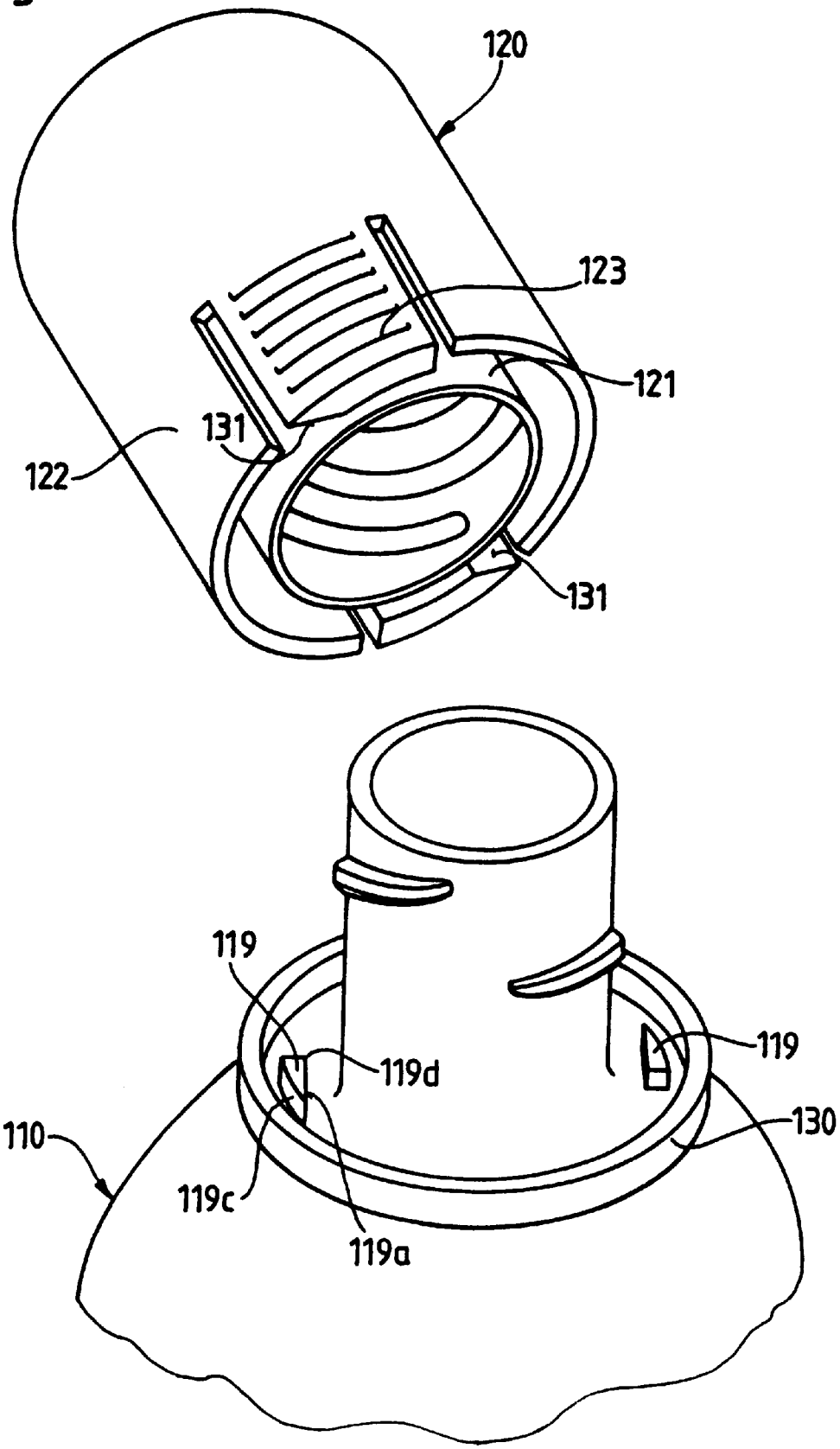
Figure 2C:
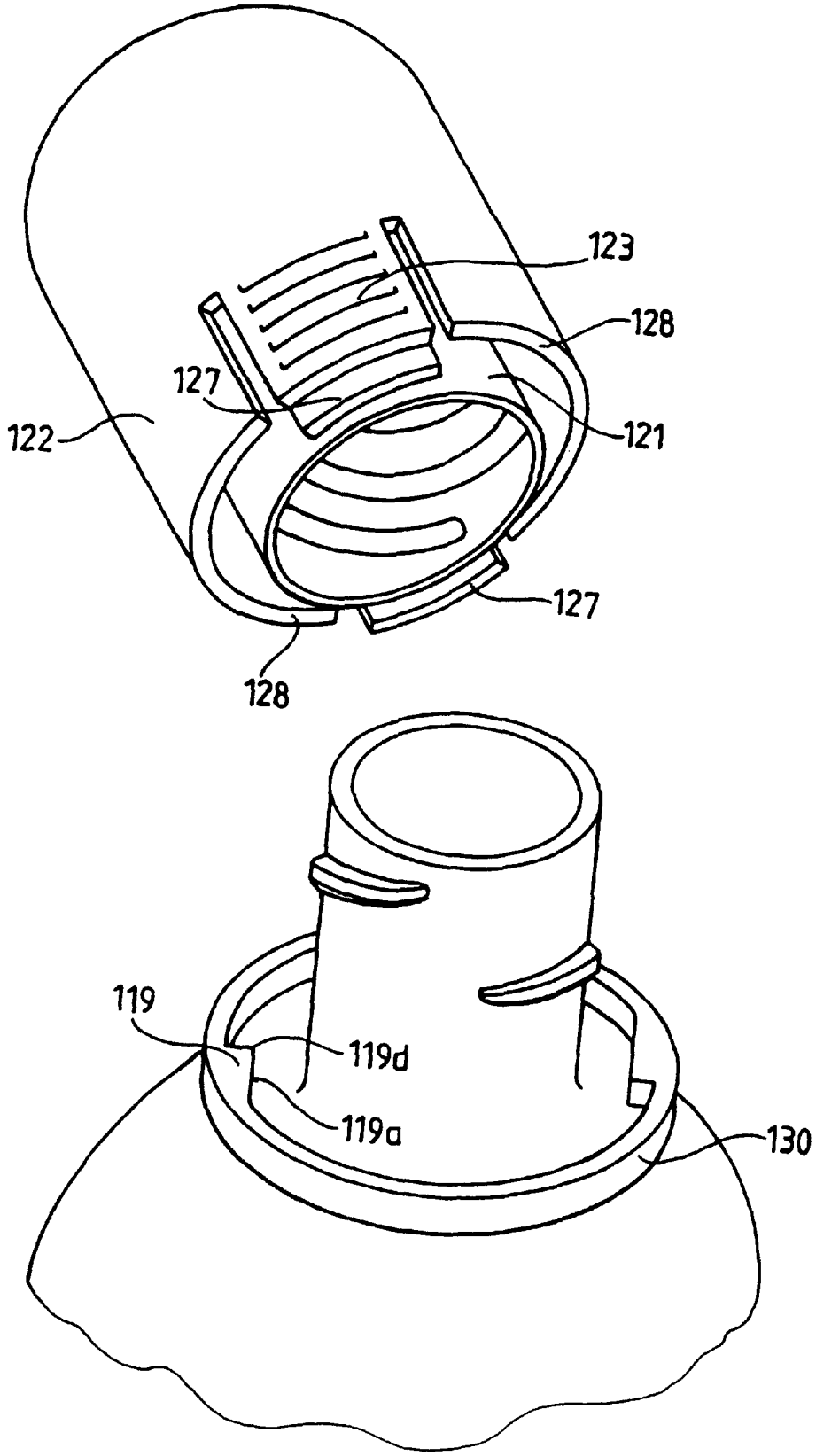
Figure 2D:
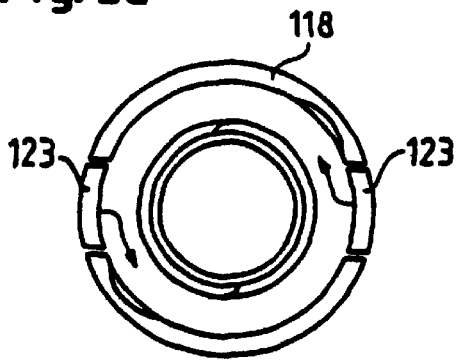
FIGS. 2*d* and 2*e* are cross sectional top views of another child resistant package according to the present invention.
Figure 2F:
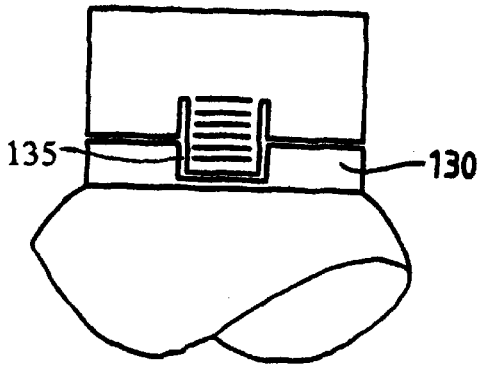
FIG. 2*f* is a front view of a child resistant package according to the present invention.
Figure 2G:
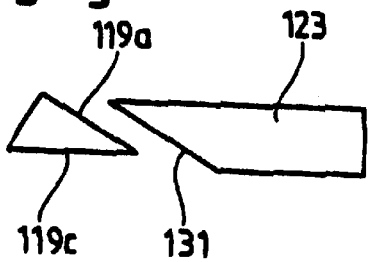
FIGS. 2*g* and 2*h* are partial cross sectional views of the interlocking tooth and the pushtab, the pushtab further comprising a guiding ramp.
Figure 2E:
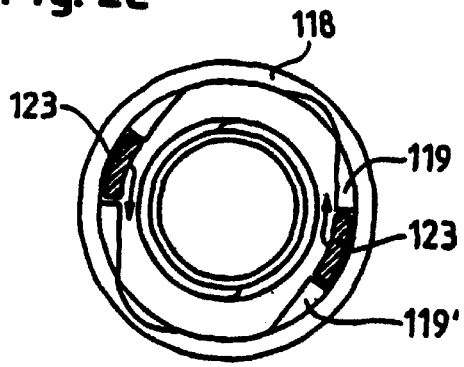

As a preferred option, said shoulder portion may further comprise a surrounding wall (FIG. 2*b*, 130). Preferably, said surrounding wall is concentrically aligned to said opening (112). Said interlocking tooth (119) may be a separate part, distanced from said surrounding wall (FIG. 2*b*), or may be part of the innermost or outermost surface of said surrounding wall (FIG. 2*c* and FIG. 2*e*). As a preferred option, said surrounding wall may be interrupted with a cut (135) through the thickness of said surrounding wall (FIG. 2*d*). The dimension of said cut is such to give complete access to said pushtab from the outside of said closure, at least partially accommodating said pushtab (123). In this case, said cut in said surrounding wall acts as an interlocking tooth, as illustrated in FIG. 2*d*. Indeed, said pushtab (123) has first to deflected inwardly towards said neck portion such that said pushtab is between said neck portion and said surrounding wall. In this case, said pushtab extends over the bottom edge (128) of said outer skirt (122) of said closure, as shown in FIG. 2*f*.

Figure 12:
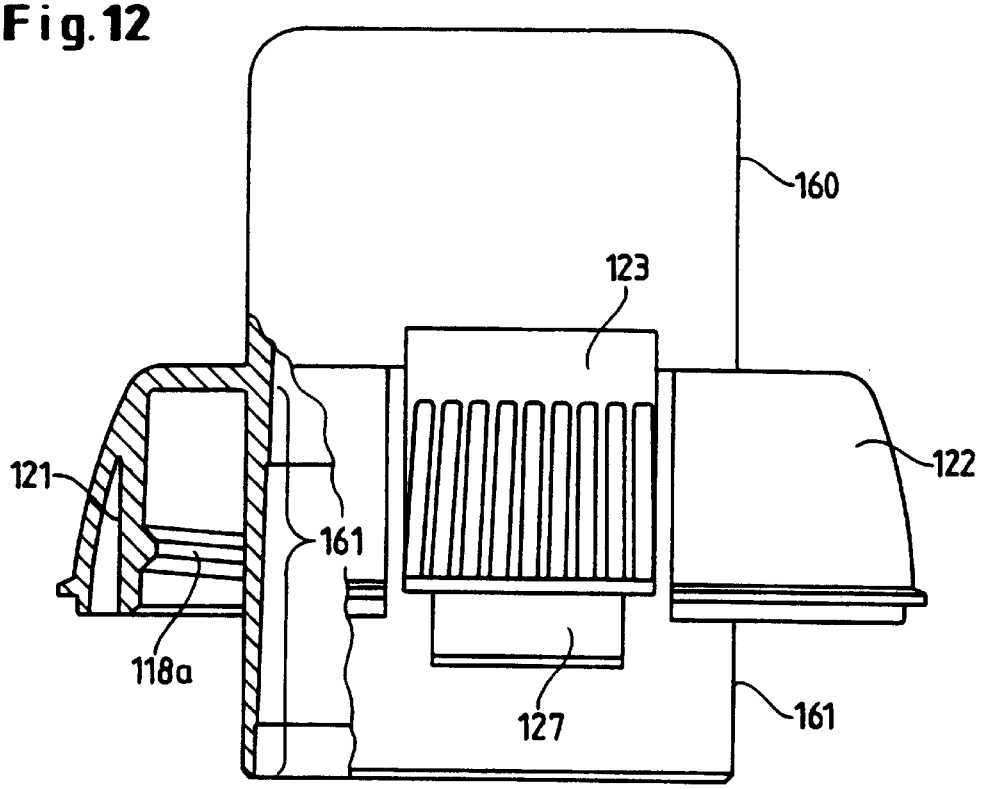
FIG. 12 is a cross sectional front view of another embodiment of a closure of a child resistant package according to the present invention.

Another essential feature of the present invention is said closure (120). Said closure comprises an inner skirt (121), an outer skirt (122), a top wall (129) and at least a resiliently deformable pushtab (123). As a preferred option, said closure may be also a measuring and dispensing cap. An example of a measuring and dispensing cap according to the present invention is shown in FIG. 12. The measuring chamber is delimited by the surrounding wall (160). The part (161) of said surrounding wall plunges into said opening (112) of said container when said measuring and dispensing cap closes said container. Said measuring and dispensing cap further comprises said inner (121) and outer (122) skirt and at least a deformable pushtab (123). In the embodiment shown in FIG. 12, said second engaging means (118*a*) of said measuring and dispensing cap is on the innermost surface of said inner skirt. As a preferred option, said pushtab further comprises a downward extension (127).

Said inner or outer skirt comprises on at least one of its surfaces second engaging means (118*a*) complementary to said first engaging means (118) of said upper portion (115) for releasably securing said closure to said container. Preferably, said second engaging means for releasably securing said closure to said container is a combination of lugs and screw threads or a snapping mechanism comprising ribs and/or grooves, corresponding to said first engaging means on said upper portion. Preferably, said second engaging means for releasably securing said closure to said container is located on the innermost surface of said inner or outer skirt of said closure. The second engaging means for releasably securing said closure to said container ensures that said closure closes said container in a leak tight manner. As a preferred option, said closure further comprises a plug (154) closing said reduced opening (151) of said spout. Indeed, this plug fits into said reduced opening of said spout, as shown in FIG. 4*b*. The plug plonges at least partially into said channel (152). In this manner, said plug further improves the leak tightness when said container is closed with said closure.

Figure 2H:
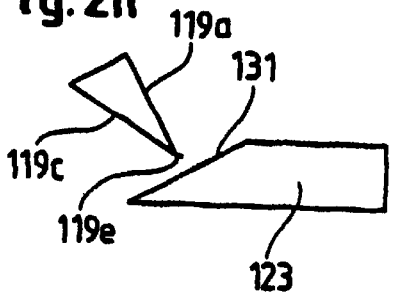
Figure 2I:
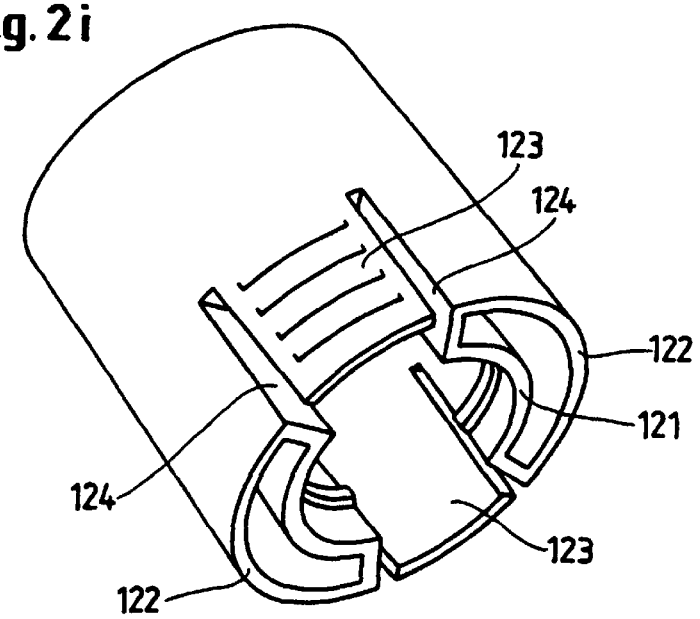
FIG. 2*i* is a perspective view of an embodiment of a closure of a child resistant package according to the present invention.

As a preferred option, said inner skirt (121) may be interrupted in correspondence of said pushtab (123) just behind said pushtab, as shown in FIG. 2*i*. The interruption corresponds in dimension to the dimension of said pushtab. In this manner, said pushtab can be deformed without being limited by an inner skirt which may act otherwise as a stopper. We found that the interruption of said inner wall just behind said pushtab provides a greater flexibility to said pushtab. Consequently, said inner skirt comprises partial second engaging means. Said inner skirt may be connected through the connecting walls (124) to said outer skirt.

Figure 4A:
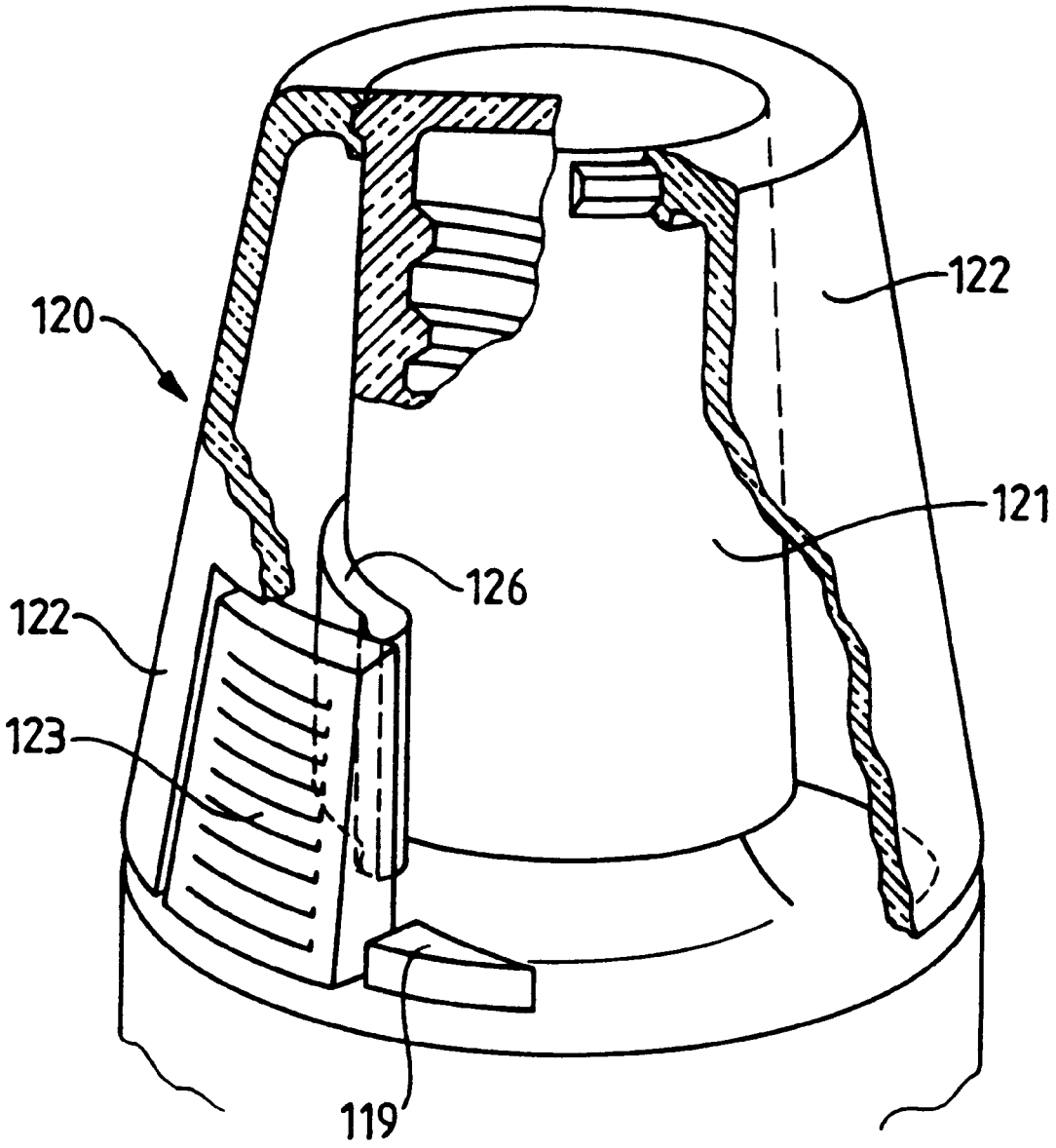
FIG. 4*a* is a front view, partially cut through the thickness, of an embodiment of a closure of a child resistant package according to the present invention.

Another essential feature of said closure is said pushtab (123). Said pushtab is the part of said closure interacting with said interlocking tooth (119). Said pushtab may be part or attached to said inner skirt (121) and/or to said outer skirt (122). Said pushtab has an exposed outermost surface contour which generally conforms to the exterior outermost surface contour of the adjacent portions of said outer skirt of said closure. This minimises the chance of inadvertent depression of said pushtab when said outer skirt is grasped. Said pushtab may be positioned anywhere on said outer skirt, e.g. at different distances from the top wall (129) of said closure. For example, said pushtab in FIG. 4*a* is located away from said top wall, whereas in FIG. 4*b* said pushtab is further towards said top wall.

Figure 3A:
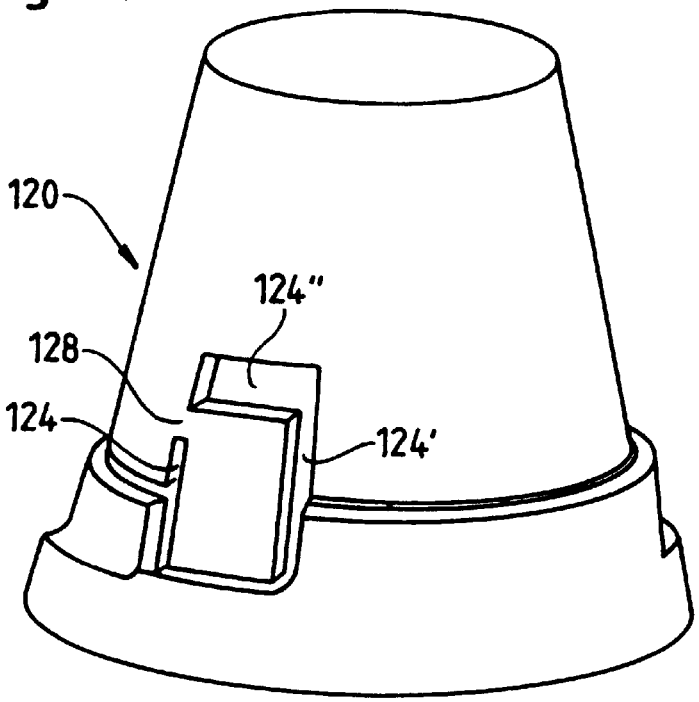
FIG. 3*a* is a front view of the upper portion of another embodiment of a child resistant package according to the present invention.

FIG. 2*a* shows an embodiment of the present invention in which said pushtab is part of said outer skirt, and whereby said pushtab is formed by at least a pair of parallel slots (124, 124'). In this manner, said pushtab is fixed to said outer skirt along the drawn line (125) perpendicular to said slots. Therefore, said pushtab is cantilevered to said outer skirt of said closure. Another possibility is shown in FIG. 3*a*, in which said pushtab is also part of said outer skirt, formed by three slots (124, 124' and 124") and connected to said outer skirt through the transition portion (128).

Figure 3B:
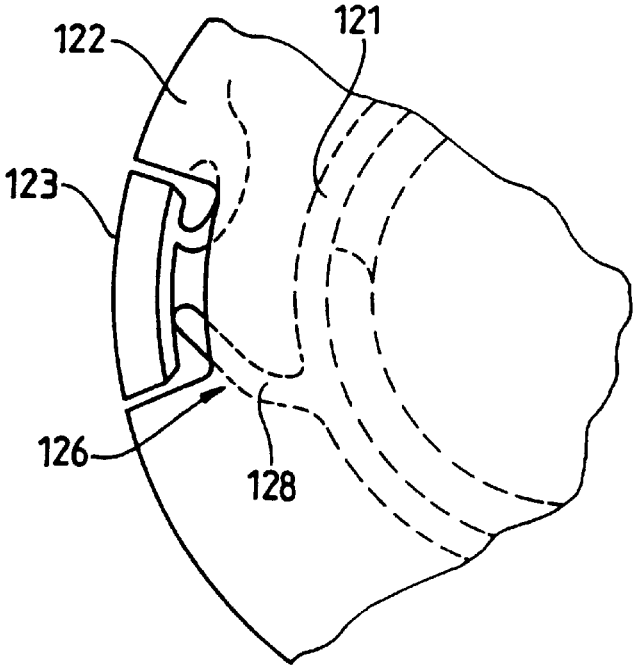
FIG. 3*b* illustrates cross sectional top view of the upper portion of another child resistant package according to the present invention.

As a preferred option, a spring (126) may be located between said inner skirt and said pushtab being part of said outer skirt, as illustrated, for example, in FIG. 3*b*. In this case, said spring is made of a flexible and resilient arm (128). Preferably, said spring is attached to or part of said inner skirt (121) at one end and attached to or leant against said pushtab at the opposite end of said flexible and resilient arm. As another preferred option, said pushtab (123) may be independent from said outer skirt. Indeed, said pushtab and said inner skirt may be connected together with said spring (126), as shown, for example, in FIG. 4*a*. FIG. 4*b* illustrates an example in which at least the part of said inner skirt attached to said pushtab (123) is formed into an S-shaped spring (126). The S-shaped spring provides the flexibility and resiliency to said pushtab. In this case, said outer skirt (122) comprises a cut through the thickness of said outer skirt. Said cut has substantially the same dimension of said pushtab, giving complete access to said pushtab from the outside of said closure and fully accommodating said pushtab (123).

Figure 5B:
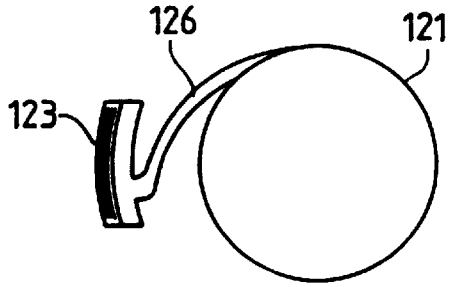
FIG. 5*b* is a cross sectional top view taken along line (A,A') of FIG. 5*a*.
Figure 5A:
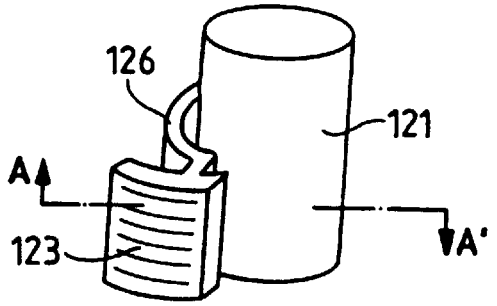
FIG. 5*a* shows a partial front view of another embodiment of a closure of a child resistant package according to the present invention.
Figure 6B:
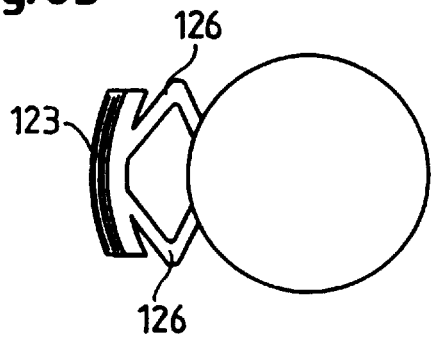
FIG. 6*b* is a cross sectional top view taken along line (A,A') of FIG. 6*a*.
Figure 6A:
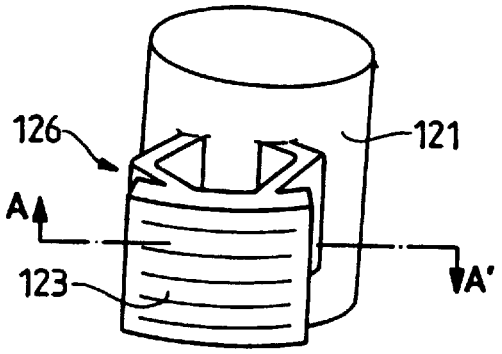
FIG. 6*a* shows a partial front view of another embodiment of a closure of a child resistant package according to the present invention.
Figure 7B:
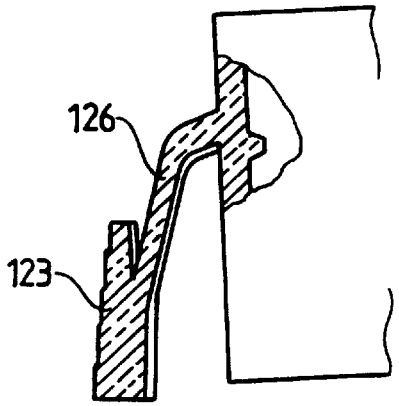
FIG. 7*b* is a cross sectional top view taken along line (B,B') of FIG. 7*a*.
Figure 7A:
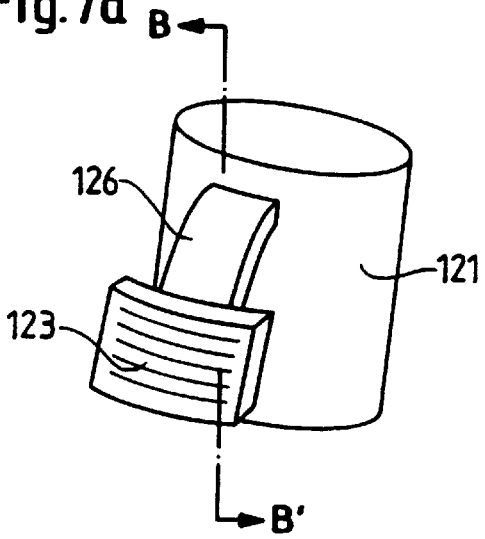
FIG. 7*a* shows a partial front view of another embodiment of a closure of a child resistant package according to the present invention.

Said spring (126) according to the present invention is not limited by any particular form of said spring. Indeed, said spring may be of several different forms, as shown in FIGS. 5 to 8. FIG. 5*a* illustrates a perspective front view of a closure without said outer skirt, but showing said pushtab (123), said spring (126) and said inner skirt (121). In this case, said spring comprises one flexible and resilient arm (128). This same execution is shown in FIG. 5*b* in a cross sectional view taken across line (A-A') of FIG. 5*a*. As a preferred alternative, said flexible and resilient arm (128) may also be positioned perpendicularly, as shown in FIG. 7*a*, with respect to the flexible and resilient arm (128) of FIG. 5*a*. FIG. 7*b* illustrates a cross sectional view across line (B-B') of FIG. 7*a*.

Figure 8A:
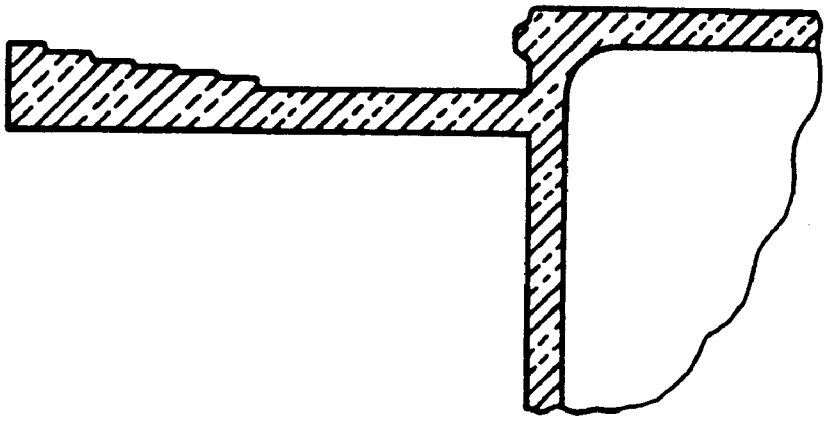
FIGS. 8*a* and 8*b* show partial cross sectional front views of another embodiment of a closure of a child resistant package according to the present invention.
Figure 8B:
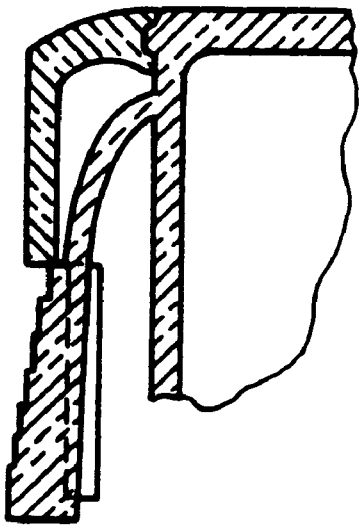

FIGS. 8*a* and 8*b* represent cross sectional views also across line (B-B') of FIG. 7*a*, illustrating a preloaded pushtab (123). Indeed, in a first manufacturing process said flexible and resilient arm (128) is made substantially perpendicular to said inner skirt (121), as shown in FIG. 8*a*. Than, in a second manufacturing process, said outer skirt is made whereby said arm is bent downwards and kept by said outer skirt, as shown in FIG. 8*b*. In this manner, said outer skirt preloads said pushtab. As another preferred option, said spring (126) may comprise more than one flexible and resilient arm, as shown, for example, in FIGS. 6*a* and 6*b*. Preloading of said pushtab (123) may be achieved with any form of pushtab and/or spring (126) described before in FIGS. 5 to 7.

Figure 9A:
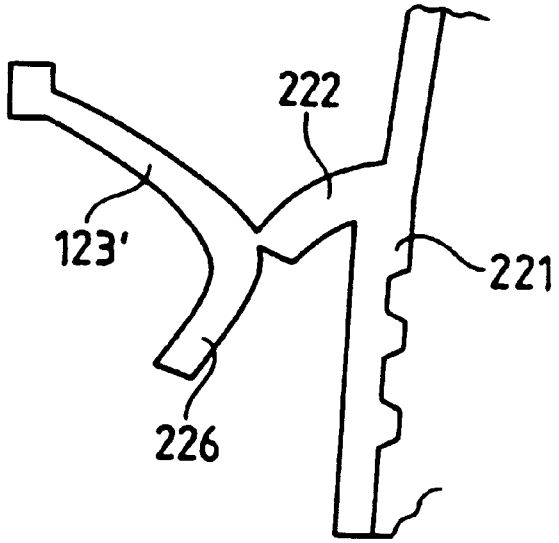
FIG. 9*a* is a cross sectional side view of another embodiment of a closure of a child resistant package according to the present invention.
Figure 9B:
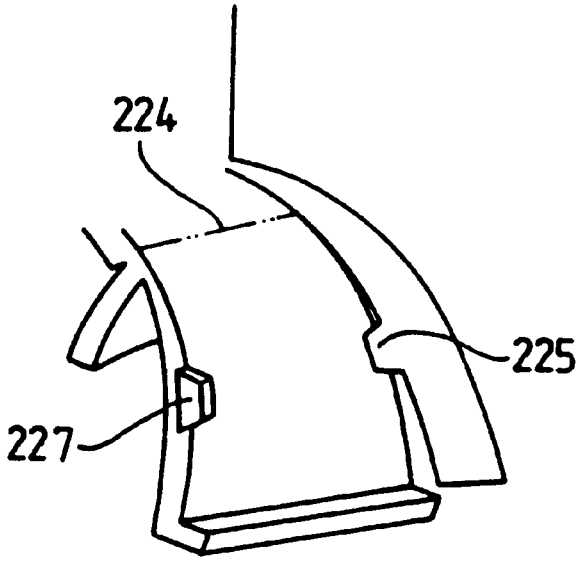
FIG. 9*b* is a partial front view of the child resistant closure of FIG. 9*a*.

Another embodiment of a child resistant closure (200) with a preloaded pushtab (123') is shown in FIGS. 9*a* and 9*b*. Said closure (200) comprises said inner (221) and outer skirt (222). Said outer skirt further comprises a hinged pushtab (123'), said pushtab being hinged along the drawn line (FIG. 9*b*, 224). Preferably, said pushtab may further comprise a spring (226). Furthermore, said pushtab and/or said outer skirt comprises at least a pair of lateral wings (FIG. 9*b*, 225). Again, in the manufacturing process said flexible and resilient pushtab is made substantially perpendicular to said inner skirt (221), as shown in FIG. 9*a*. Than, said pushtab can be pushed down towards said outer skirt and locked within said outer skirt by said lateral wings, as shown in FIG. 9*b*. Indeed, said lateral wings impede that said pushtab springs back to the initial position of FIG. 9*a*, i.e. said lateral wings maintain said pushtab locked within said outer skirt. Therefore, this allows to provide a preloaded pushtab. When said lateral wings are located on said outer skirt, said lateral wings are over the outermost surface of said pushtab. Vice versa, when said lateral wings are located on said pushtab, said lateral wings press on the innermost surface of said outer skirt. To better conform to the exterior surface contour of the adjacent portions of said outer skirt, said pushtab and/or said outer skirt may preferably further comprise recesses (227) corresponding to said lateral wings. Indeed, said lateral wings may seat within said recesses.

It is believed that preloading of said pushtab ensures positive locking with said interlocking tooth (119) even in situations where manufacturing tolerances drift beyond specific limits. If no preloading of said pushtab is present, drifts in manufacturing tolerance can reduce the required amount of travel for said pushtab and thereby permit disengaging of said closure (120) with less depression of said pushtab. Furthermore, we found that adults having impaired manual strength and dexterity do not find the preloading of said pushtab to pose any additional opening difficulty for them. Indeed, the level of preloading is not so great as to significantly increase the total force required to release said pushtab from said interlocking tooth and permit disengaging of said closure. Therefore, the adults are more prone to reapply said closure to said package once the desired amount of contents has been removed rather than leaving said closure only partially secured to or completely off of said package after initial opening.

On the contrary, we found an improved child resistance when preloading said pushtab (123') and/or spring (126). While the precise phenomenon which produces said improved child resistance is not fully understood, it is believed that preloading of said pushtab and/or spring offers a degree of initial resistance to the depression exerted by children. This may discourage children from attempting to further depress said pushtab while concurrently applying an disengaging force to said closure (120). Thus, the chances that said closure will be inadvertently opened by someone who does not understand the opening mechanism is substantially reduced. Another benefit of a preloaded pushtab is that the resiliency of said pushtab is better preserved, especially when said pushtab and/or spring is made of a particular material, like polypropylene.

Said package (100) according to the present invention is closed and opened in the following manner. In the simplest execution of FIG. 2*a* having screw threads as first and second engaging means, the maximum thickness of said pushtab (123) is greater compared to the thickness of the outer skirt (122). When the closure is screwed on the container to close the package, the innermost surface of the outer skirt passes in front of the outermost surface of the interlocking tooth. However, the pushtab, which has a greater thickness with respect to the outer skirt, has to be deflected to pass around the interlocking tooth. In this case, the deflection of the pushtab may be helped by a guiding ramp (131). The guiding ramp is an inclined ramp located between the innermost and the outermost surface of the pushtab and on the part of the pushtab which first comes in contact with the interlocking tooth when the closure is screwed in the closing direction. The direction along the guiding ramp can be substantially parallel to the direction along the inclined wall (119*a*), as shown in a cross section view of FIG. 2*g*. Alternatively, the, edge (119*e*) which is the interconnecting edge between the inclined wall (119*a*) and the outermost surface (119*c*) of the interlocking tooth may point towards the guiding ramp, as shown in a cross section view of FIG. 2*h*. When the guiding ramp is made like in FIG. 2*g*, then the pushtab is inwardly deflected towards said neck portion (117) whenever said closure is turned in the closing rotation. On the contrary, when the guiding ramp is like in FIG. 2*h*, the pushtab is outwardly deflected passing in front of the outermost surface (119*c*) of the interlocking tooth whenever said closure is turned in the closing rotation.

FIGS. 2*d*, 2*e*and 4*a* illustrate the position of said pushtab, when said closure is fully threaded onto said container. Said radial wall (119*b*) of said interlocking tooth impedes that said pushtab may rotate in the reverse opening direction without first pushing inwardly onto said pushtab. Indeed, to unscrew said closure from said container, once said closure is fully assembled onto said shoulder portion (116), said pushtabs must be inwardly depressed towards said dispensing opening (118) such that said pushtab disengage from said interlocking tooth. Said pushtab must be depressed until the thickness of said pushtab overcomes the innermost edge (119*d*) of said radial wall (119*b*). Now it is possible to turn said closure in the opening direction and to unscrew said closure from said container. Thereby at least part of said pushtab faces the innermost surface of said interlocking tooth when said closure is disengaged from said container. In other words, this means that at least part of said pushtab passes adjacent to the innermost surface of the interlocking tooth when disengaging said closure from said container. In case said closure comprises two pushtabs interacting correspondingly with two interlocking teeth on said shoulder portion of said container, then both pushtabs must be depressed together to unscrew said closure from said container.

The unscrewing of said closure from said container needs only a one-hand operation. Indeed, it is possible to grasp said closure (120) with one hand and at the same time to depress said pushtab(s) with one or two fingers of the same hand grasping said closure before turning said closure to open said package. This one-hand operation is allowed by the fact that said pushtab is positioned on said closure itself. Therefore, the other hand may be used only to hold said container without needing to interact in the opening operation. We found that packages, which are uneasy to hold due to their unwieldy shape, especially when these packages have a large dimension and/or weight, comprising the child resistant closure according to the present invention can be firmly grasped and easily opened also by elderly adults having impaired manual strength and dextrity. Therefore, the risk of having said package slipped from the hand is substantially reduced.

The squeezing force required to depress said pushtab(s) (123) is preferably great enough to be difficult for a child, yet low enough for adults, especially for elderly adults having impaired manual strength and dextrity, to readily depress said pushtab(s). The preferred squeezing force for said pushtab(s) is believed to be in the range of about 2.2 N (0.5 pounds) and about 22.2 (5 pounds). In addition, said pushtab (s) are preferably substantially flush with the outermost surface of said outer skirt (122) of said closure (120). In this manner, grasping said closure about its outer skirt is unlikely to permit said pushtab(s) from inadvertently disengaged from said interlocking teeth (119). Rather, a conscious decision to squeeze said pushtab(s) must be made by the user to initiate the opening process. This minimises the chance that a child will be able to remove said closure (120) simply by squeezing the entire outermost surface of said outer skirt (122) in his or her hand while trying to unscrew said closure.

FIG. 2*b* illustrates an embodiment of said package according to the present invention comprising a surrounding wall (130). Said interlocking tooth is distanced and a separate part of said surrounding wall. Again, said pushtab (123) has a greater thickness compared to the outer skirt (122). Consequently, the pushtab has to be deflected to pass around the interlocking tooth, as described for FIG. 2*a*. Again the deflection of the pushtab may be helped by the guiding ramp (131), preferably by the guiding ramp as shown in FIG. 2*g*. Consequently, the pushtab deflects in such a manner that the outermost surface of the pushtab passes behind the outermost surface (119*c*) of the interlocking tooth along the inclined ramp (119*a*), herein referred to as inward deflection. This inward deflection is preferable, since a greater space for the deflection of the pushtab is available. Indeed, the free space in front of the outermost surface of the interlocking tooth is limited by the distance to the innermost surface of the surrounding wall. Similarly as for the embodiment of FIG. 2*a*, when said closure is turned in the closing position, said pushtab is deflected, whereas the outer skirt passes between said surrounding wall and the outermost surface (119*c*) of said interlocking tooth. To open said package, said pushtab has to be pushed until the thickness of said pushtab overcomes said innermost edge (119*d*) of said interlocking tooth, as described before in FIG. 2*a*.

Said interlocking tooth (119) in FIG. 2*c* is part of said surrounding wall (130). In this case, said pushtab (123) comprises a downward extension (127) instead of the guiding ramp (131) of FIGS. 2*a* and 2*b*. Said downward extension projects over the bottom edge (128) of said outer skirt (122) and is located between said outer and inner (121) skirt. When said closure is screwed on said container, said downward extension is deflected as usual by said inclined wall (119*a*) of said interlocking tooth (119), whereby the rest of said pushtab and said outer skirt remains above the top surface (129) of said surrounding wall. To open said package, said downward extension has to be inwardly pushed by depressing said pushtab until the thickness of said downward extension overcomes said innermost edge (119*d*) of said interlocking tooth. FIG. 2*e* illustrates the same embodiment of FIG. 2*c* further comprising two opposing interlocking teeth (119, 119'). This further opposing interlocking tooth (119') limits the movement of said pushtab once said closure is in its closing position. We found that this limited movement allowed in the closing position further discourages childs to open said closure.

Figure 10A:
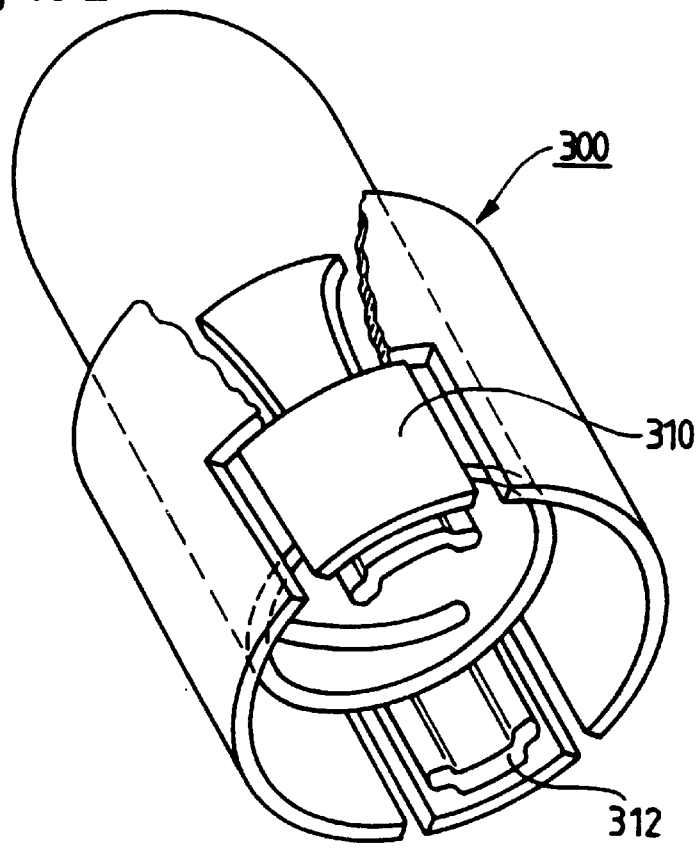
FIG. 10*a* is a perspective view of an embodiment of a closure of a child resistant package according to the present invention.
Figure 10B:
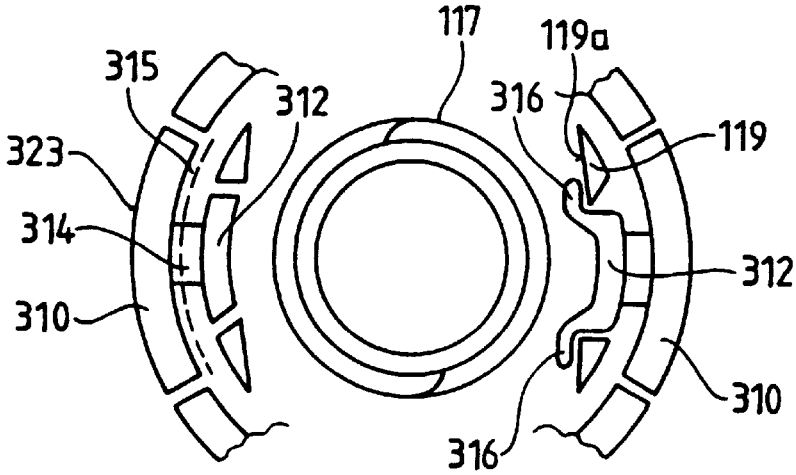
FIG. 10*b* is a cross section bottom view of the child resistant closure of FIG. 10*a*.

Another preferred embodiment of a child resistant closure (300) according to the present invention is shown in FIG. 10*a*. As shown in FIG. 10*b*, left half, said pushtab (323) comprises an outer wall (FIG. 10*b*, 310) and an inner wall (312). Said inner wall is connected with said outer wall. As a preferred option, said inner wall is connected with said outer wall through a connecting portion (314). A channel (315) is delimited by said inner wall, said outer wall and said connecting portion. When said closure is screwed onto said container, mainly said inner wall of said pushtab is deflected and locked by said interlocking tooth (119). Said outer wall of said pushtab may also partially deflect being connected to said inner wall of said pushtab. Said interlocking tooth passes between said inner and outer wall of said pushtab through said channel (315). Another possibility is that said inner wall of said pushtab is deflected principally upwards when pressing on said pushtab such that said inner wall of said pushtab passes over said interlocking tooth. As a preferred option, the radial wall (119*b*) of said interlocking tooth has a height which decreases towards the edge (119*d*) of said radial wall. This decrease of the height of said radial wall facilitates the disengagement of said pushtab from said interlocking tooth.

As described above, said radial wall (119*b*) of said interlocking tooth (119) impedes that said inner wall (314), and consequently said pushtab (323), may rotate in the reverse opening direction without any action on said pushtab. Indeed, to unscrew said closure (300) from said container, once said closure is fully assembled onto said shoulder portion (116), said pushtab must be inwardly depressed towards said dispensing opening (118) such that said inner wall (312) disengages from said interlocking tooth. Said pushtab must be depressed until the thickness of said inner wall overcomes the edge (119*d*) of said radial wall (119*b*). Now it is possible to turn said closure in the opening direction and to unscrew said closure from said container.

As a preferred option, said inner wall (314) may further comprise on its innermost surface a lateral wall (FIG. 10*b*, right half, 316) on each side of said inner wall (312). Said lateral wall is parallel to said inner wall and is located slightly behind said inner wall towards said neck portion (117) between said interlocking tooth and said neck portion (117) when said closure is in its closing position. Said lateral wall ensures that said inner wall of said pushtab passes on said inclined wall (119*a*) of said interlocking tooth when unscrewing said closure. Consequently, said interlocking tooth is obliged to pass through said channel (315). This may be especially useful when said shoulder portion (FIG. 2*a*, 116) does not comprise a surrounding wall (FIG. 2*b*, 130). Indeed, it may happen otherwise that said inner wall of said pushtab may pass on the outermost surface (119*c*) of said interlocking tooth without having to first deflect said pushtab bypassing the child resistance of said closure.

Figure 13A:
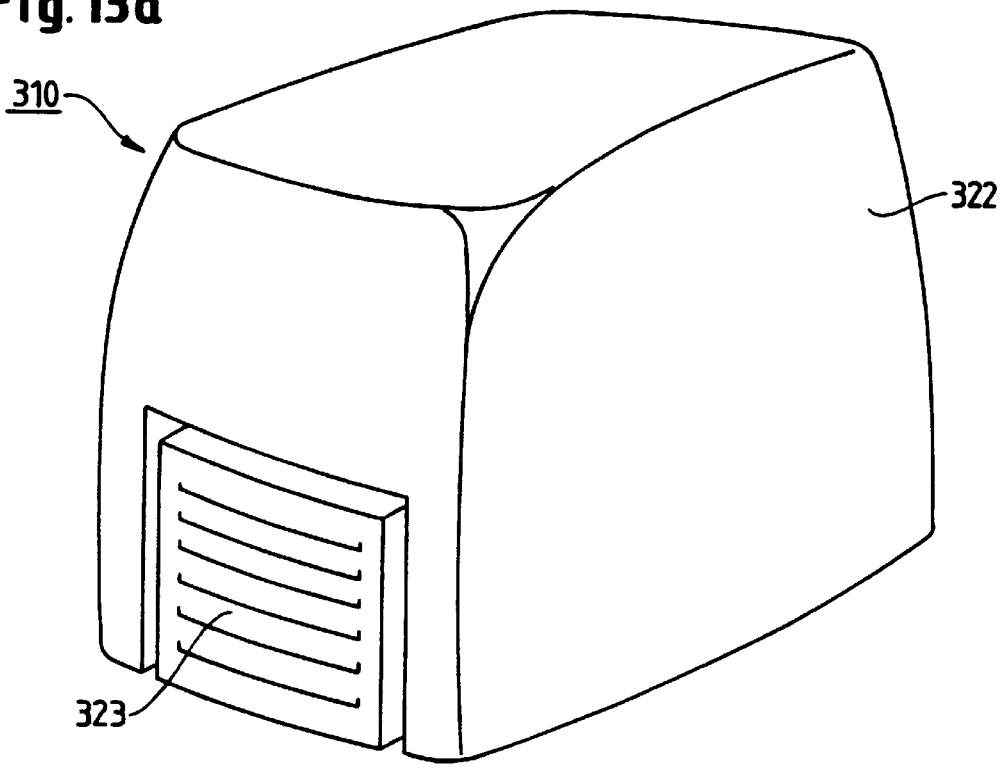
FIG. 13*a* is a perspective front view of another embodiment of a closure of a child resistant package according to the present invention which is shown in more detail in partial cuts in FIGS. 13*b* and 13*c*.
Figure 13B:
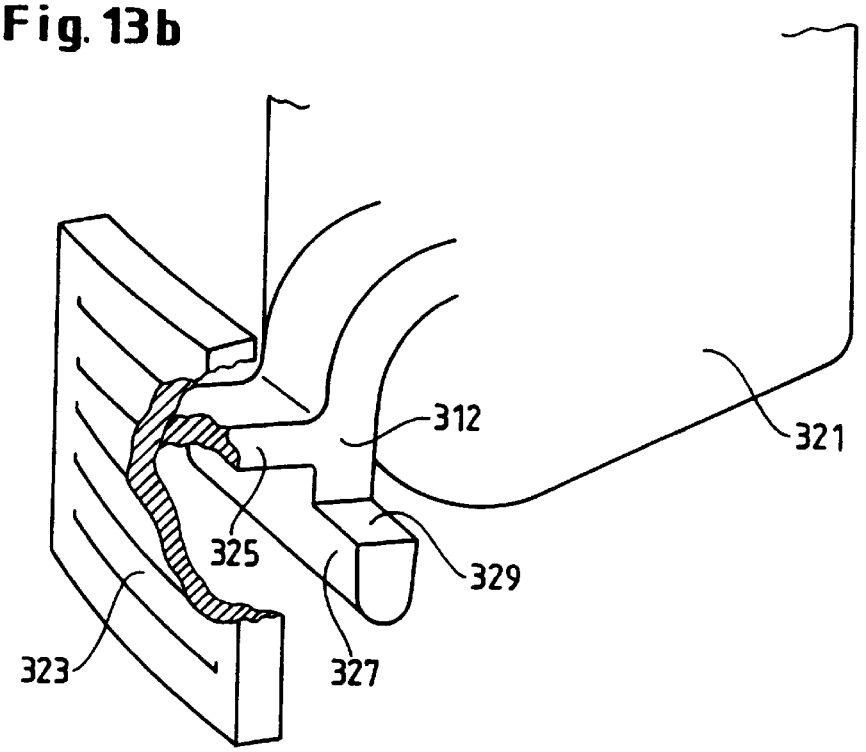
FIG. 13*d* is a partial cut of a variation of the closure of a child resistant package of FIGS. 13*b* and 13*c*.

An example of a closure (310) according to the present invention comprising as first and second engaging means a snapping mechanism is shown in FIGS. 13*a* to 13*d* The outer shape of said closure in FIG. 13*a* is similar to said closure shown in FIG. 4*a*. FIG. 13*b* illustrates said closure of FIG. 13*a* without said outer skirt (322). Said closure comprises said inner skirt (321), said pushtab (323), an inner wall (312) of said pushtab similar to the inner wall described in FIGS. 10*a* 10*b*, a connecting part (325) connecting said pushtab to said inner wall of said pushtab and a lug (327). Said lug is an extension of said inner wall which interacts with said interlocking tooth (319), shown in FIG. 13*c*, to achieve a child resistant closure of the package according to the present invention. Said interlocking tooth is located as before on the upper portion of said container. Specifically, said lug interacts with said interlocking tooth in such a manner that said closure cannot be pulled off from the corresponding container before said pushtab is pressed. Indeed, only when pushing on said pushtab allows said lug to get free from said interlocking tooth, and consequently to pull off said closure from said container.

Figure 13C:
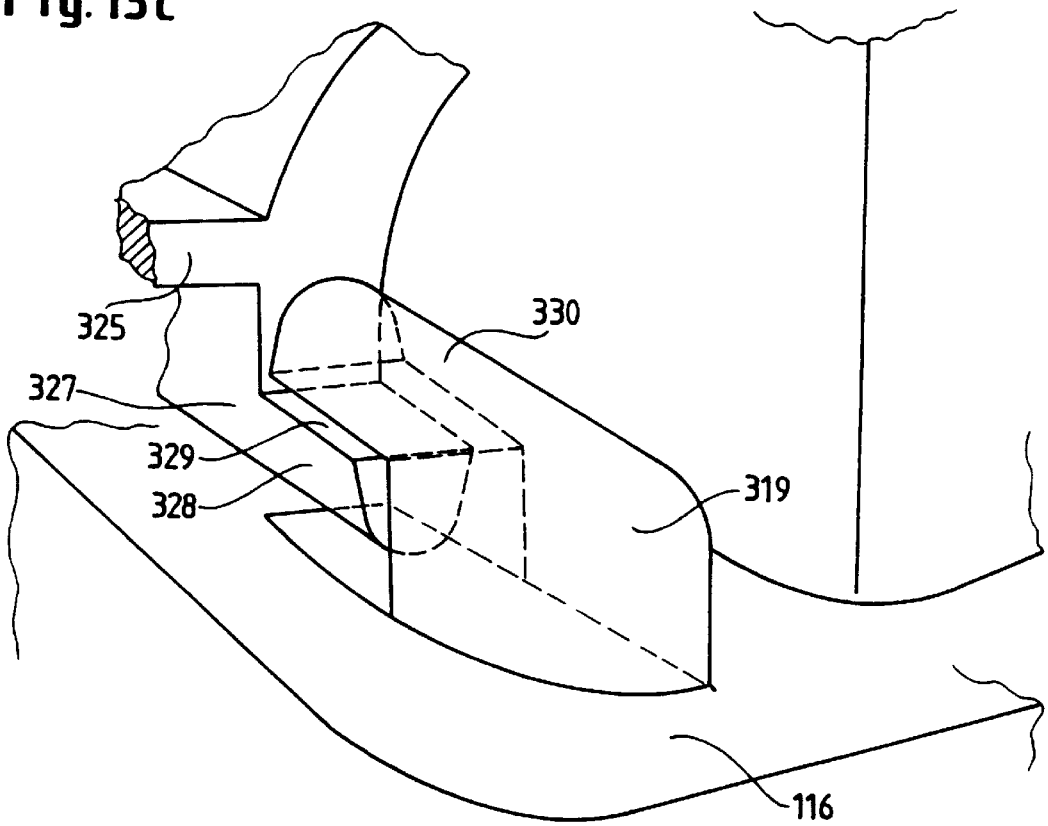
Figure 13D:
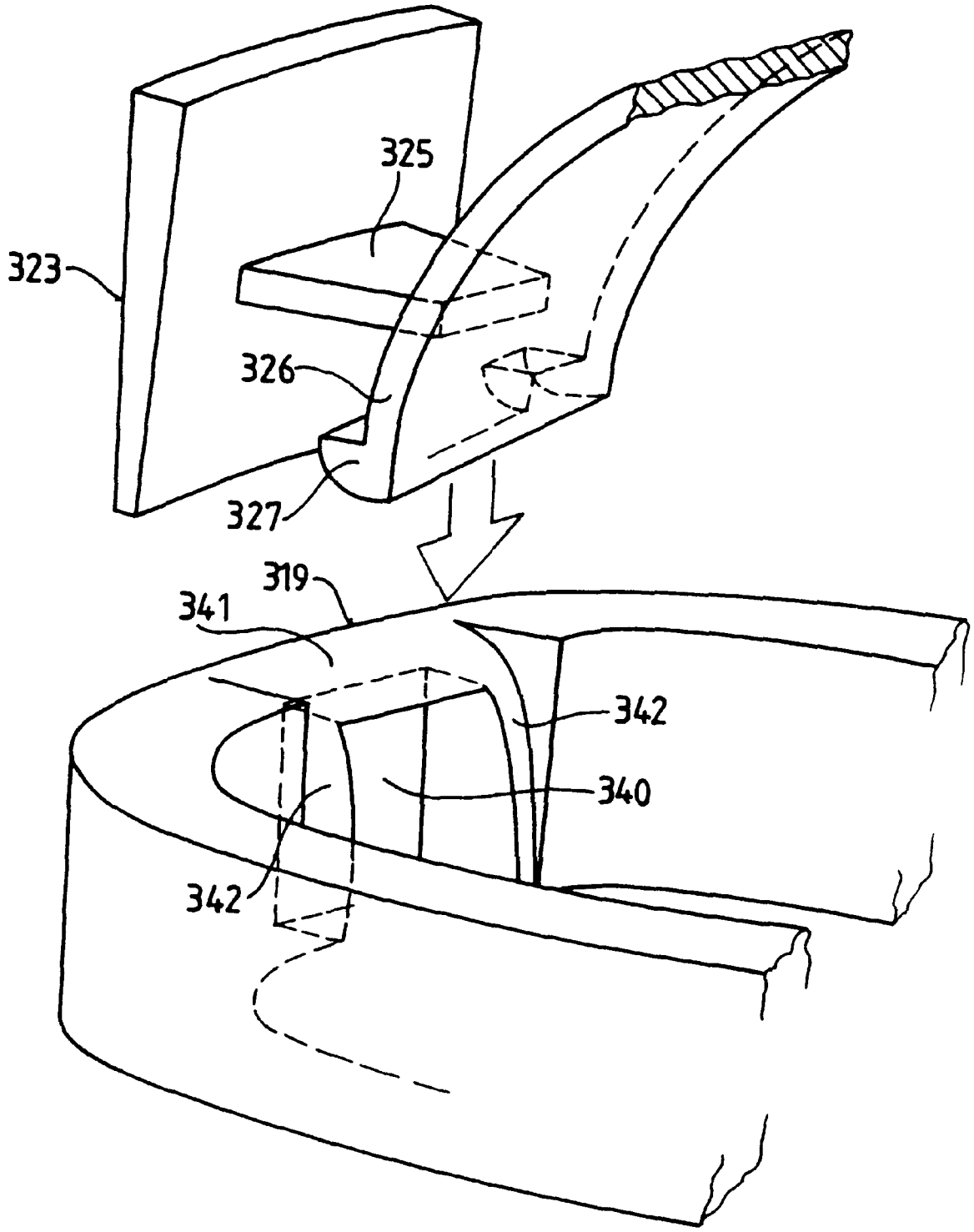

In a preferred embodiment said lug and said interlocking tooth are made as shown in FIGS. 13*c* and 13*d*. Said lug comprises a lateral extension (328) comprising a flat upper wall (329). Said extension may have a cylindrical shape. Preferably, said extension has a semi-rounded cylindrical shape as shown in FIGS. 13*b* and 13*c* which facilitates an easy snapping on of said closure on said container. Said interlocking tooth further comprises a roof (330) extending from the upper portion of said interlocking tooth. Said roof and said lug interact with each other in such a manner that said lug is located under said roof when said closure is in its closed position on said container. Consequently, in this position said closure cannot be simply pulled off from said container. Indeed, when trying to pull off said closure with an upward movement, said flat upper wall of said lug comes in interaction with the lower surface of said roof. Thereby a further upward movement of said closure is prevented.

The only way to open said container is first to push on said pushtab (323), thereby inwardly deflecting said inner wall (312) towards the inner skirt (321) of said closure. Indeed, said inner wall is connected to said pushtab by said connecting part (325). Consequently, also said lug (327) is pushed away from said roof (330). Said closure can be easily pulled off once said lug is not vertically aligned, i.e. not under said roof. We found that this provides child resistance to said closure according to the present invention. When said closure is snapped onto said container, said lug passes on one side of said roof. Thereby said inner wall is deflected inwardly towards said inner skirt or outwardly away from said inner skirt. Once said lug has overpassed said roof, said inner wall returns to the undeflected position where said lug is positioned under said roof as shown in FIG. 13*c*.

Another preferred embodiment of the present invention is shown in FIG. 13*d*. In this case at least a lug (327) is located on said closure on the lower portion of said inner wall (312) between said pushtab (323) and said inner wall (312) and under said connecting part (325). Said lug interlocks in between the arc (340). The arc comprises a roof (341) limited by two colums (342). Said lug is again under said roof in between said columns when said closure is in its closed position on said container. To open said container the same principle as discussed before apply also in this case. When said closure is pushed onto said container for closing, said spring deflects inwardly towards said container, such that said lug snaps under said roof.

Figure 11:
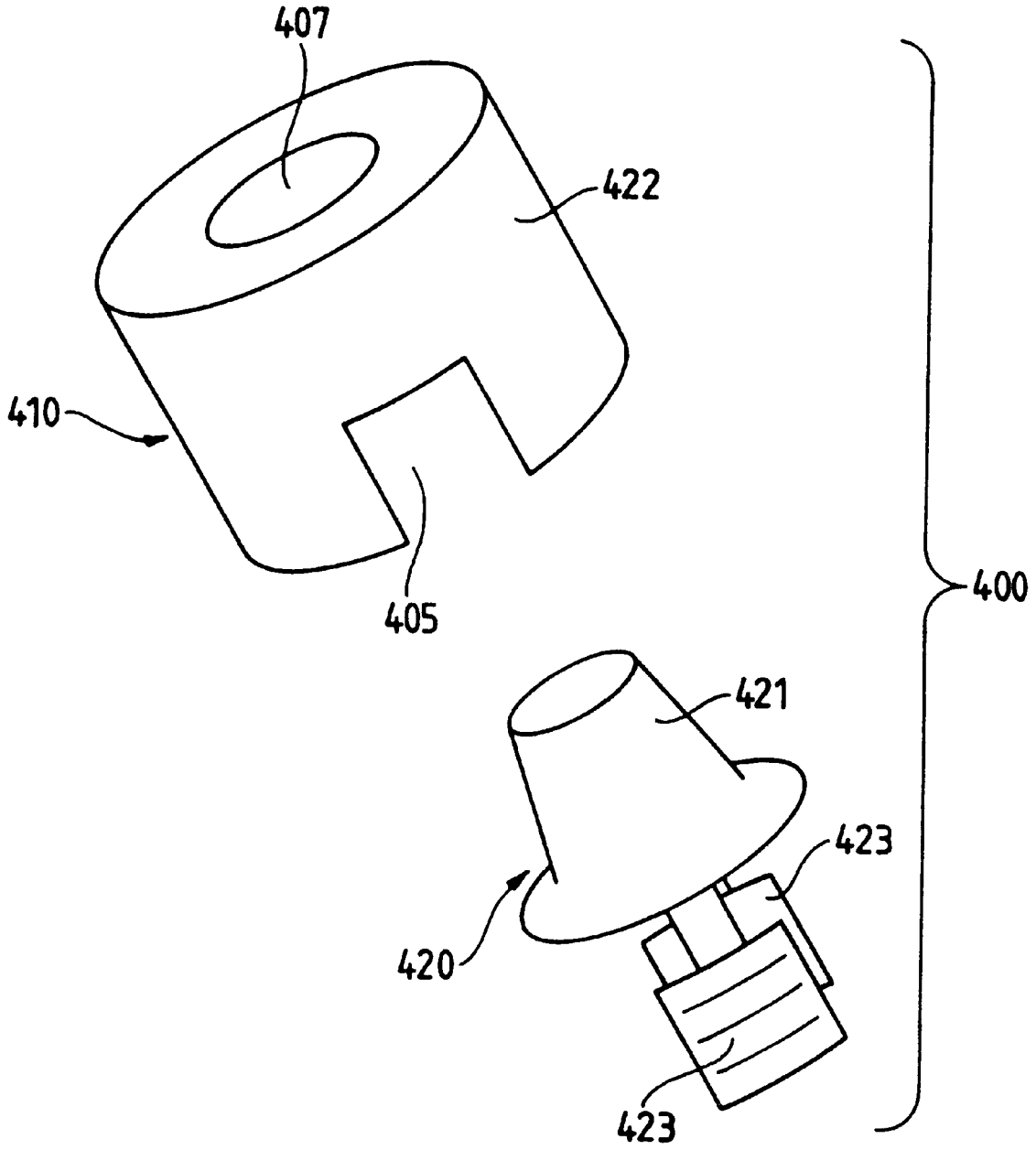
FIG. 11 is a perspective view of another embodiment of a closure of a child resistant package according to the present invention.

Another possible embodiment of a closure for said child resistant package according to the present invention is shown in FIG. 11. Said closure (400) comprises a housing (410) and a fitment (420). Said housing comprises said outer skirt and cuts through the thickness of said housing corresponding to the location of said two pushtabs (423). Said fitment further comprises said inner skirt (421) and said two pushtabs. Said fitment is inserted inside said housing to complete the closure (400) which can be applied onto a container according to the present invention. Preferably, said housing has an upper hole (407) and said fitment comprises a hat (421) passing at least partially through said upper hole (407). In this case, said fitment provides the closure of said container. Each feature described until here with the help of FIGS. 2 to 13 can be put in different combinations with any of the other features for a child resistant package according to the present invention.

Preferably, said closure (120) is made of thermoplastic material. Such thermoplastic materials have been extensively described in the art and include vinyl chloride based resins, polymers and co-polymers derived from olefins, acrylic polymers and co-polymers, polyethylene, polypropylene, polystyrene, polyethylene terephthalate, polyethylene terephthalate glycol, or mixtures thereof. Said closure can be made of single or multi-layer extrusion of such materials. It can also comprise recycled thermoplastic materials. A preferred thermoplastic material used herein is polypropylene. Different parts of said closure, like said pushtab (123) or said spring (126), may be made of a different thermoplastic material than said inner (121) or outer skirt (122). Parts of different thermoplastic material may be co-injected together. Indeed, we found that said pushtab or spring of different forms or of a different material with respect to the rest of said closure allows to vary the flexibility of said pushtab, i.e. to vary the force needed to be applied on said pushtab.

As a preferred option, said package (100) according to the present invention may further comprise a pilferproof system. The pilfer-proof system enables the user to check when buying the package according to the present invention filled with a product that said package has not been opened before by someone else. Said pilferproof system may be achieved with break-off spurs (140) or with a pull-out ring (145). Said break-off spurs attach said closure (120) to said shoulder portion (116). This attachment achieved with said break-off spurs is easily broken off when said package is opened for the first time. Said pull-out cover is a cover over said opening (112) or reduced opening (151). Consequently, the access to the content of said package can be achieved only after uncovering said opening from said pull-off cover. As a preferred option, said pull-off cover further comprises a ring extending from said pull-off cover. Said ring facilitates the uncovering of said opening from said pull-off cover. Indeed, the user may insert a finger in said ring, and consequently pull-off said cover.

Said package (100) according to the present invention is suitable for storing and dispensing potentially dangerous products. Potentially dangerous products are products which may hurt the health of children and adults when not used in a conscious manner and with the correct dosage. Medicaments and cleaning products are, for example, such products. These products may be in solid, tablet, granular, powdered, semi-solid, paste or liquid form. Preferably, said package according to the present invention contains liquid cleaning products, like a hard surface cleaner or a toilet bowl cleaner.

We claim:

1. A child-resistant package (100) comprising a container (110) and a closure (120), said package being suitable for storing and dispensing potentially dangerous products, said container comprising an upper portion (115), said upper portion comprising a first engaging means (118) for releasably securing said closure to said container, said closure comprising an inner skirt (121) which comprises second engaging means (118*a*) corresponding to said first engaging means of said upper portion for releasably securing said closure to said container, said closure further comprising an outer skirt (122), generally concentrically aligned with said inner skirt, said upper portion of said container further comprises at least an interlocking tooth (119), and said closure further comprises at least one resiliently deformable pushtab (123), said upper portion (115) further comprises a neck portion (117) and a shoulder portion (116), said neck portion comprising an opening (112), said shoulder portion comprising at least said interlocking tooth (119), said shoulder portion (116) further comprises a surrounding wall (130), and said interlocking tooth (119) a cut (135) through the thickness of said surrounding wall, said cut being dimensioned to fully accommodate said pushtab (123), and at least part of said pushtab is inwardly moveable when a squeezing force is applied to said inwardly movable part of said pushtab, said pushtab having an exposed surface contour which generally conforms to the exterior surface contour of the adjacent portions of said outer skirt, said interlocking tooth and said pushtab being so formed and positioned to prevent removing of said closure from said container to open said package unless said pushtab is first depressed to disengage said pushtab from said interlocking tooth before said container is opened, and at least part of said exposed surface contour of said pushtab faces the innermost surface of said interlocking tooth when said closure is disengaged from said container.

2. A child-resistant package (100) comprising a container (110) and a closure (120), said package being suitable for storing and dispensing potentially dangerous products, said container comprising an upper portion (115), said upper portion comprising a first engaging means (118) for releasably securing said closure to said container, said closure comprising an inner skirt (121) which comprises second engaging means (118*a*) corresponding to said first engaging means of said upper portion for releasably securing said closure to said container, said closure further comprising an outer skirt (122), generally concentrically aligned with said inner skirt, said upper portion of said container further comprises at least an interlocking tooth (119), said closure farther comprises at least one resiliently deformable pushtab (123), said pushtab (123) is connected with a spring (126) to said inner skirt (121) of said closure (120), and at least part of said pushtab is inwardly moveable when a squeezing force is applied to said inwardly movable part of said pushtab, said pushtab having an exposed surface contour which generally conforms to the exterior surface contour of the adjacent portions of said outer skirt, said interlocking tooth and said pushtab being so formed and positioned to prevent removing of said closure from said container to open said package unless said pushtab is first depressed to disengage said pushtab from said interlocking tooth before said container is opened, and at least part of said exposed surface contour of said pushtab faces the innermost surface of said interlocking tooth when said closure is disengaged from said container.

3. A package according to claim 2 wherein said spring (326) comprises a lug (327) and said interlocking tooth comprises a roof (330).

4. A child-resistant package (100) comprising a container (110) and a closure (120), said package being suitable for storing and dispensing potentially dangerous products, said container comprising an upper portion (115), said upper portion comprising a neck portion (117) and a first engaging means (118) for releasably securing said closure to said container, said closure comprising an inner skirt (121) which comprises second engaging means (118*a*) corresponding to said first engaging means of said upper portion for releasably securing said closure to said container, said closure further comprising an outer skirt (122), generally concentrically aligned with said inner skirt, said upper portion of said container further comprises at least an interlocking tooth (119), said closure further comprises at least one resiliently deformable pushtab (123), said pushtab comprises an inner wall (312) and an outer wall (310), said inner wall further comprises a lateral wall (316) which is located slightly behind said inner wall towards said neck portion between said interlocking tooth and said neck portion when said closure is in its closing position, and at least part of said pushtab is inwardly moveable when a squeezing force is applied to said inwardly movable part of said pushtab, said pushtab having an exposed surface contour which generally conforms to the exterior surface contour of the adjacent portions of said outer skirt, said interlocking tooth and said pushtab being so formed and positioned to prevent removing of said closure from said container to open said package unless said pushtab is first depressed to disengage said pushtab from said interlocking tooth before said container is opened, and at least part of said exposed surface contour of said pushtab faces the innermost surface of said interlocking tooth when said closure is disengaged from said container.

5. A child-resistant package (100) comprising a container (110) and a closure (120), said package being suitable for storing and dispensing potentially dangerous products, said container comprising an upper portion (115), said upper portion comprising a first engaging means (118) for releasably securing said closure to said container, said closure comprising an inner skirt (121) which comprises second engaging means (118*a*) corresponding to said first engaging means of said upper portion for releasably securing said closure to said container, said closure further comprising an outer skirt (122), generally concentrically aligned with said inner skirt, wherein said upper portion of said container further comprises at least an interlocking tooth (119), said upper portion comprises a neck portion (117) and a shoulder portion (116), said shoulder portion further comprises a surrounding wall (130), said closure further comprises at least one resiliently deformable pushtab (123), said pushtab is preloaded to provide a force against said surrounding wall, said pushtab comprises lateral wings (225), which will maintain said pushtab locked within said skirt, and at least part of said pushtab is inwardly moveable when a squeezing force is applied to said inwardly movable part of said pushtab, said pushtab having an exposed surface contour which generally conforms to the exterior surface contour of the adjacent portions of said outer skirt, said interlocking, tooth and said pushtab being so formed and positioned to prevent removing of said closure from said container to open said package unless said pushtab is first depressed to disengage said pushtab from said interlocking tooth before said container is opened, and at least part of said exposed surface contour of said pushtab faces the innermost surface of said interlocking tooth when said closure is disengaged from said container.

6. A child-resistant package (100) comprising a container (110) and a closure (120), said package being suitable for storing and dispensing potentially dangerous products, said container comprising an upper portion (115), said upper portion comprising a first engaging means (118) for releasably securing said closure to said container, said closure comprising an inner skirt (121) which comprises second engaging means **(118*a*) corresponding to said first engaging means of said upper portion for releasably securing said closure to said container, said closure further comprising an outer skirt (122), generally concentrically aligned with said inner skirt, said upper portion of said container further comprises at least two interlocking teeth (119), said closure further comprises two pushtabs (123) opposite to each other, said closure (400) comprises a housing (410) and a fitment (420), said housing comprising said outer skirt and cuts through the thickness of said housing corresponding to the location of said two pushtabs (423), and said fitment is inserted inside said housing, said fitment further comprising said inner skirt (421)** and said two pushtabs, and at least a part of said pushtabs is inwardly moveable when a squeezing force is applied to said inwardly movable part of said pushtabs, said pushtabs having an exposed surface contour which generally conforms to the exterior surface contour of the adjacent portions of said outer skirt, said interlocking teeth and said pushtabs being so formed and positioned to prevent removing of said closure from said container to open said package unless said pushtabs are first depressed to disengage said pushtabs from said interlocking teeth before said container is opened, and at least part of said exposed surface contour of said pushtabs faces the innermost surface of said interlocking teeth when said closure is disengaged from said container.

7. A package according to claim 6 wherein said housing has an upper hole (407) and said fitment passes at least partially through said hole, said fitment providing the closure of said container.

8. A child-resistant package (100) comprising a container (110) and a closure (120), said package being suitable for storing and dispensing potentially dangerous products, said container comprising an upper portion (115). said upper portion comprising a first engaging means (118) for releasably securing said closure to said container, said closure comprising an inner skirt (121) which comprises second engaging means **(118*a*) corresponding to said first engaging means of said upper portion for releasably securing said closure to said container, said closure further comprising an outer skirt (122), generally concentrically aligned with said inner skirt, wherein said upper portion of said container further comprises at least an interlocking tooth (119), said upper portion comprises a neck portion (117) and a shoulder portion (116), said shoulder portion further comprises a surrounding wall (130), said closure further comprises at least one resiliently deformable pushtab (123), said pushtab is preloaded to provide a force against said surrounding wall, said outer skirt (122) comprises lateral wings (225)**, which will maintain said pushtab locked within said skirt, and at least part of said pushtab is inwardly moveable when a squeezing force is applied to said inwardly movable part of said pushtab, said pushtab having an exposed surface contour which generally conforms to the exterior surface contour of the adjacent portions of said outer skirt, said interlocking tooth and said pushtab being so formed and positioned to prevent removing of said closure from said container to open said package unless said pushtab is first depressed to disengage said pushtab from said interlocking tooth before said container is opened, and at least part of said exposed surface contour of said pushtab faces the innermost surface of said interlocking tooth when said closure is disengaged from said container.

* * * * *